US008359790B2

(12) United States Patent
Shin

(10) Patent No.: US 8,359,790 B2
(45) Date of Patent: Jan. 29, 2013

(54) MULTI DOORLOCK USING BRAKING RESISTANCE OF DC MOTOR

(76) Inventor: Jeong-Hun Shin, Jeollanam-do (KR)

( * ) Notice: Subject to any disclaimer, the term of this patent is extended or adjusted under 35 U.S.C. 154(b) by 321 days.

(21) Appl. No.: 12/520,456

(22) PCT Filed: Mar. 3, 2009

(86) PCT No.: PCT/KR2009/001045

§ 371 (c)(1),
(2), (4) Date: Jun. 19, 2009

(87) PCT Pub. No.: WO2009/110734

PCT Pub. Date: Sep. 11, 2009

(65) Prior Publication Data

US 2010/0315229 A1 Dec. 16, 2010

(30) Foreign Application Priority Data

Mar. 3, 2008 (KR) ..... 10-2008-0019658
Mar. 3, 2008 (KR) ..... 10-2008-0019667

(51) Int. Cl.
*E05F 15/02* (2006.01)
*E05F 15/10* (2006.01)
*G08B 21/00* (2006.01)

(52) U.S. Cl. ..... 49/26; 49/31; 49/138; 340/540

(58) Field of Classification Search ..... 340/540; 49/31, 26, 138
See application file for complete search history.

(56) References Cited

U.S. PATENT DOCUMENTS

| | | | | |
|---|---|---|---|---|
| 4,727,679 | A * | 3/1988 | Kornbrekke et al. | 49/138 |
| 5,018,304 | A * | 5/1991 | Longoria | 49/340 |
| 5,782,036 | A | 7/1998 | Bertieri et al. | |
| 6,417,637 | B2 * | 7/2002 | Fitzgibbon et al. | 318/459 |
| 6,745,603 | B1 * | 6/2004 | Shaw | 70/278.1 |
| 8,169,169 | B2 * | 5/2012 | Hass et al. | 318/286 |
| 8,225,458 | B1 * | 7/2012 | Hoffberg | 16/49 |
| 2004/0183677 | A1 * | 9/2004 | Fitzgibbon | 340/540 |

FOREIGN PATENT DOCUMENTS

| | | |
|---|---|---|
| JP | 2003-052403 | 2/2004 |
| JP | 2004-052403 | 2/2004 |
| JP | 2004-250955 | 9/2004 |

* cited by examiner

*Primary Examiner* — Eric M Blount
(74) *Attorney, Agent, or Firm* — Husch Blackwell, LLP

(57) ABSTRACT

A multi doorlock includes a doorlock unit (200) installed to a hinged door (100), a non-powered DC motor (300) installed to the doorlock unit, and links (400) (410) having one ends connected to the DC motor and the other ends installed to a doorframe, the links being folded or unfolded with each other when the hinged door is closed or opened. The doorlock unit (200) frequently changes a braking resistance of the DC motor (300) while the hinged door (100) is opened or closed, thereby controlling an opening/closing speed of the hinged door. A relay switch (700) is connected to both ends of a power line (330) of the DC motor (300) to short the DC motor on occasions. When it is intended to fix the hinged door (100), the relay switch (700) is operated to short the DC motor (300) such that the hinged door is not moved.

14 Claims, 11 Drawing Sheets

MULTI DOORLOCK USING BRAKING RESISTANCE OF DC MOTOR

BACKGROUND OF THE INVENTION

1. Field of the Invention

The present invention relates to a multi doorlock using a braking resistance of a DC motor, and more particularly to a multi doorlock using a braking resistance of a DC motor, which controls a moving speed of a hinged door or fixes the hinged door by installing a non-powered DC motor to a doorlock unit used for the hinged door.

2. Description of the Related Art

Generally, a hinged door is installed in a building to partition a space or allow passage from a predetermined partitioned space to another space. Seeing the hinged door in brief, a doorframe is installed to a certain portion of a wall, and hinges are installed to upper and lower portions of the doorframe. So, the hinged door may be opened or closed by means of the hinges.

When such a hinged door is opened or closed, a gap is generated between the hinged door and the doorframe to which the hinges are installed. At this time, since a conventional hinged door is not provided with a separate means for preventing a finger from being jammed and harmed in the gap, a finger of a user may be jammed and harmed in the gap when the hinged door is opened or closed. This problem is more serious to children who are more careless and more ignorant of safety than adults.

In addition, a conventional hinged door is not provided with a separate fixing function, so the hinged door in an opened state may be abruptly closed due to external interference or wind, which causes noise and even an accident.

SUMMARY OF THE INVENTION

The present invention is designed to solve the problems of the prior art, and therefore it is an object of the present invention to provide a multi doorlock using a braking resistance of a DC motor, which may have various functions selectively by basically giving a finger jamming prevention function, a door fixing function and a crime prevention function to the doorlock.

Another object of the present invention is to provide a multi doorlock using a braking resistance of a DC motor, which may control an opening/closing operation of a hinged door by installing a DC motor in a non-powered state to the doorlock installed at the hinged door and then frequently changing a braking resistance of the DC motor according to the opening/closing behavior of the hinged door.

Still another object of the present invention is to provide a multi doorlock using a braking resistance of a DC motor, which may allow easy opening of a hinged door with a small force by increasing a braking resistance of the DC motor when the hinged door is opened.

Further another object of the present invention is to provide a multi doorlock using a braking resistance of a DC motor, which may allow soft closing of a hinged door by decreasing a braking resistance of the DC motor while the hinged door is being closed and eliminate an impact of a closing hinged door by further decreasing a braking resistance of the DC motor when the hinged door is completely closed.

Still another object of the present invention is to provide a multi doorlock using a braking resistance of a DC motor, which may fix a hinged door at any location according to the user's selection by shorting the DC motor in a non-powered state and thus fixing the hinged door.

In order to accomplish the above object, the present invention provides a multi doorlock using a braking resistance of a DC motor, which includes a doorlock unit installed to a hinged door; a non-powered DC motor installed to the doorlock unit; and links having one ends connected to the DC motor and the other ends installed to a doorframe, the links being folded or unfolded with each other when the hinged door is closed or opened, wherein the doorlock unit frequently changes a braking resistance of the DC motor while the hinged door is opened or closed, thereby controlling an opening/closing speed of the hinged door.

Preferably, the multi doorlock further includes a relay switch connected to both ends of a power line of the DC motor to short the DC motor on occasions, wherein, when it is intended to fix the hinged door, the relay switch is operated to short the DC motor such that the hinged door is not moved.

Preferably, the multi doorlock further includes a first connection terminal installed at a side of the doorlock unit to be elastically protruded by a spring, the first connection terminal being electrically connected to a rechargeable cell that supplies power to the relay switch; and a second connection terminal installed at a position of a doorframe corresponding to the first connection terminal, the second connection terminal being connected to a main power line to supply power, wherein the first connection terminal and the second connection terminal are connected with each other to charge the rechargeable cell when the hinged door is in a closed state.

Preferably, a rechargeable cell is installed to the doorlock unit to supply power to the relay switch, and the rechargeable cell is electrically connected to the DC motor such that the rechargeable cell is charged using electricity generated from the DC motor when the DC motor is forcibly rotated while the hinged door is opened or closed.

Preferably, the doorlock unit includes a fixture button and a release button for operating the relay switch, wherein, when the fixture button is pressed, the relay switch shorts the DC motor to fix the hinged door in an opened or closed state, and wherein, when the release button is pressed, a fixed state of the hinged door is released.

Preferably, the doorlock unit includes a cable electrically connected to the doorlock unit and having a predetermined length; and an auxiliary fixture button and an auxiliary release button installed to a lower end of the cable and having the same function as the fixture button and the release button, whereby the operation of fixing or releasing the hinged door is allowed to children and old or weak persons.

Preferably, the DC motor includes a final output shaft to which a first gear is integrally formed; a first DC motor having a first output shaft to which a second gear engaged with the first gear is integrally formed, and a rotary shaft to which a third gear is integrally formed; and a second DC motor having a second output shaft to which a fourth gear engaged with the third gear is integrally formed.

Preferably, the multi doorlock further includes a rotation sensor formed at the rotary shaft of the first DC motor.

Preferably, the rotation sensor includes a rotating cam integrally connected to the rotary shaft to rotate in the same direction as the rotary shaft, the rotating cam having a long region, a rotation detection protrusion and a short region repeatedly formed on an outer periphery thereof; and a rotation sensing micro switch closely adhered to the outer periphery of the rotating cam to detect rotation of the rotating cam, wherein the rotation sensing micro switch determines that the hinged door is being opened, in case the rotating cam is rotated in a clockwise direction to subsequently pass the long region, the rotation detection protrusion and the short region repeatedly, and wherein the rotation sensing micro switch determines that the hinged door is being closed, in case the rotating cam is rotated in a counterclockwise direction to subsequently pass the short region, the rotation detection protrusion and the long region repeatedly.

Preferably, the rotation sensing micro switch is electrically connected to a controller of the doorlock unit, and wherein, when the rotation sensing micro switch detects a clockwise or counterclockwise rotation of the rotating cam, the controller instantly changes a braking resistance of the DC motor to control an opening/closing speed of the hinged door.

Preferably, the multi doorlock further includes a finger jamming detection sensor protruded out of the doorlock unit to detect whether a finger is located between the hinged door and the doorframe.

Preferably, the multi doorlock further includes a closing detection sensor installed to the doorlock unit to detect a closing state of the hinged door; and a remote controller wirelessly communicated with a controller of the doorlock unit in real time and having a crime prevention button, wherein, in case the crime prevention button of the remote controller is pressed in a state that the hinged door is closed and thus the closing detection sensor is in an "ON" state, the controller of the doorlock unit is shifted into a crime prevention mode, and wherein, in the crime prevention mode, in case an alien person forcibly opens the hinged door, the closing detection sensor is shifted into an "OFF" state and notifies the fact to the outside.

Preferably, the multi doorlock further includes a movement detection sensor installed to the doorlock unit to detect an indoor movement, wherein the movement detection sensor detects invasion of an alien person and notifies the fact to the outside using an emergency bell and/or a lamp.

Preferably, the multi doorlock further includes a door-closing cylinder installed between the links, wherein the door-closing cylinder includes a hollow guide tube connected to the link; a piston having one end guided to be inserted into or drawn from the guide tube and the other end connected to the link; and a restoring spring having one end connected to the piston and the other end connected to a fixing pin installed to the link to pull the piston into the guide tube.

Figure 1:
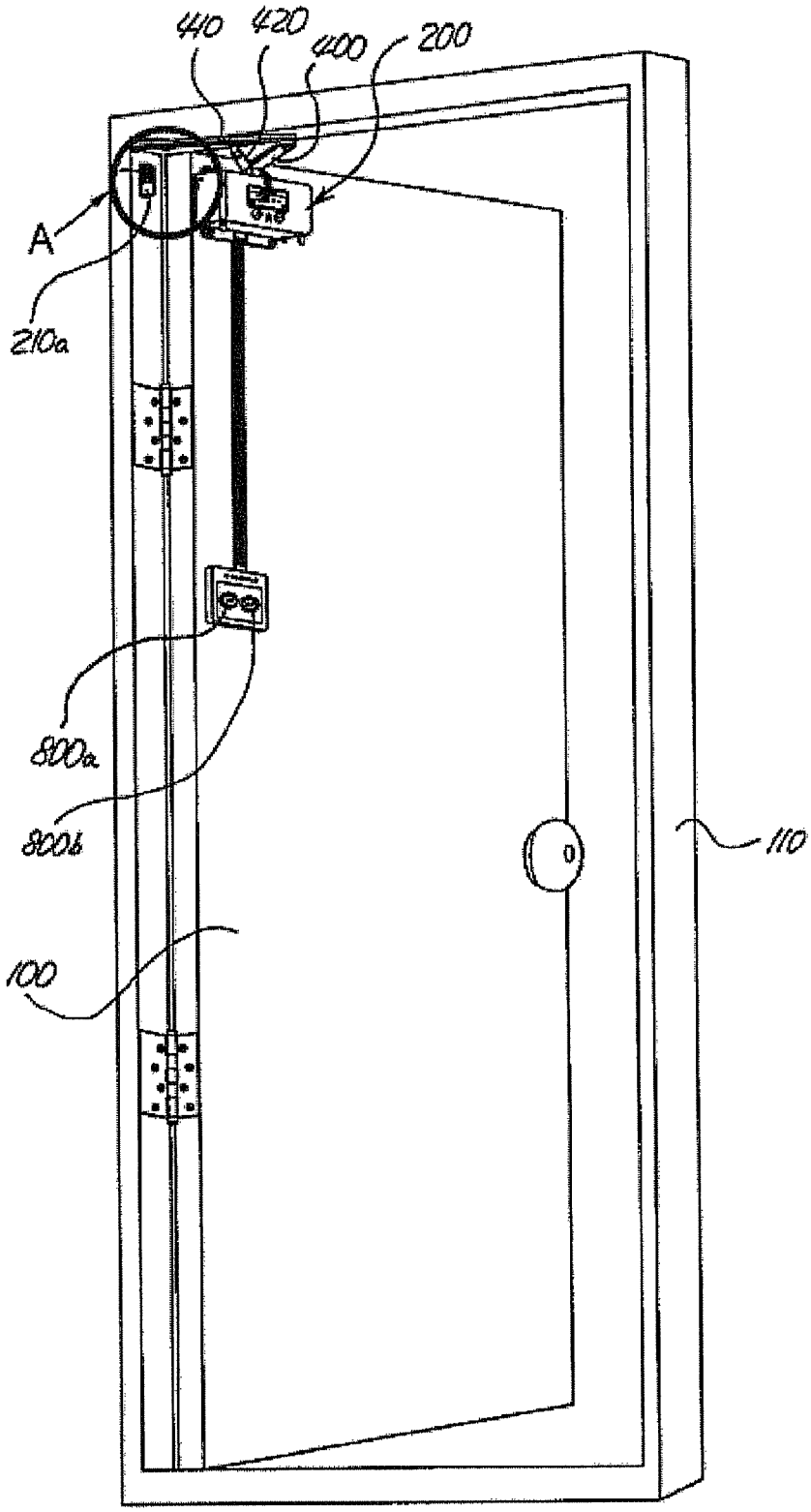
FIG. 1 is a perspective view showing a multi doorlock according to the present invention, which is installed to a hinged door.

| <Reference Numeral of Essential Parts in the Drawings> | |
|---|---|
| 100: hinged door | 200: doorlock unit |
| 300: DC motor | 310: reduction gear |
| 320: final output shaft | 321: first gear |
| 330: power line | 340: first DC motor |
| 341: second gear | 342: first output shaft |
| 343: rotary shaft | 344: third gear |
| 350: second DC motor | 351: second output shaft |
| 352: fourth gear | 360: rotation sensor |
| 361: rotation sensing micro switch | 362: rotating cam |
| 370: long region | 371: rotation detection protrusion |
| 372: short region | 400, 410: link |
| 500: controller | |

DESCRIPTION OF THE PREFERRED EMBODIMENT

Hereinafter, preferred embodiments of the present invention will be described in detail with reference to the accompanying drawings.

Figure 2:
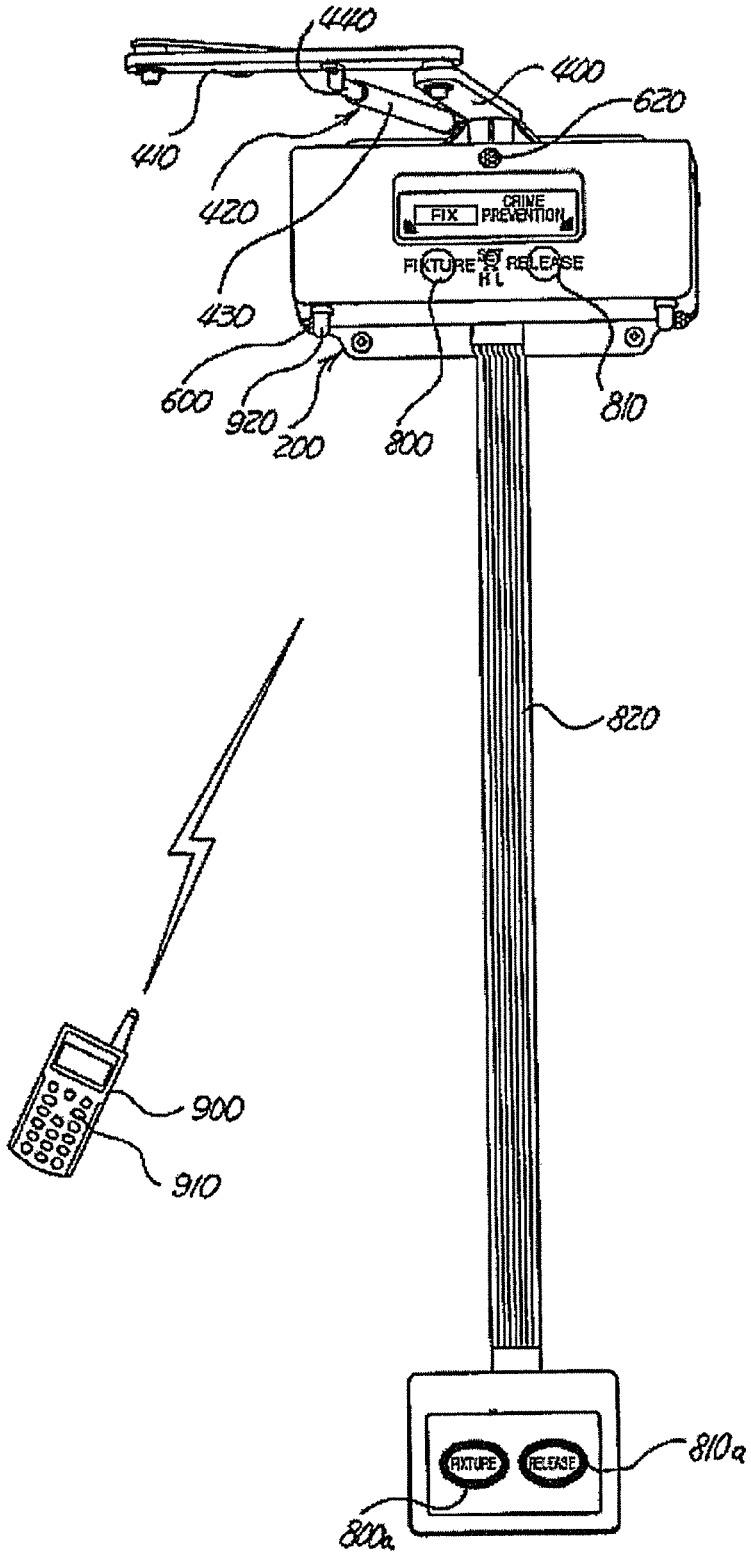
FIG. 2 is a perspective view showing the multi doorlock according to the present invention.
Figure 3:
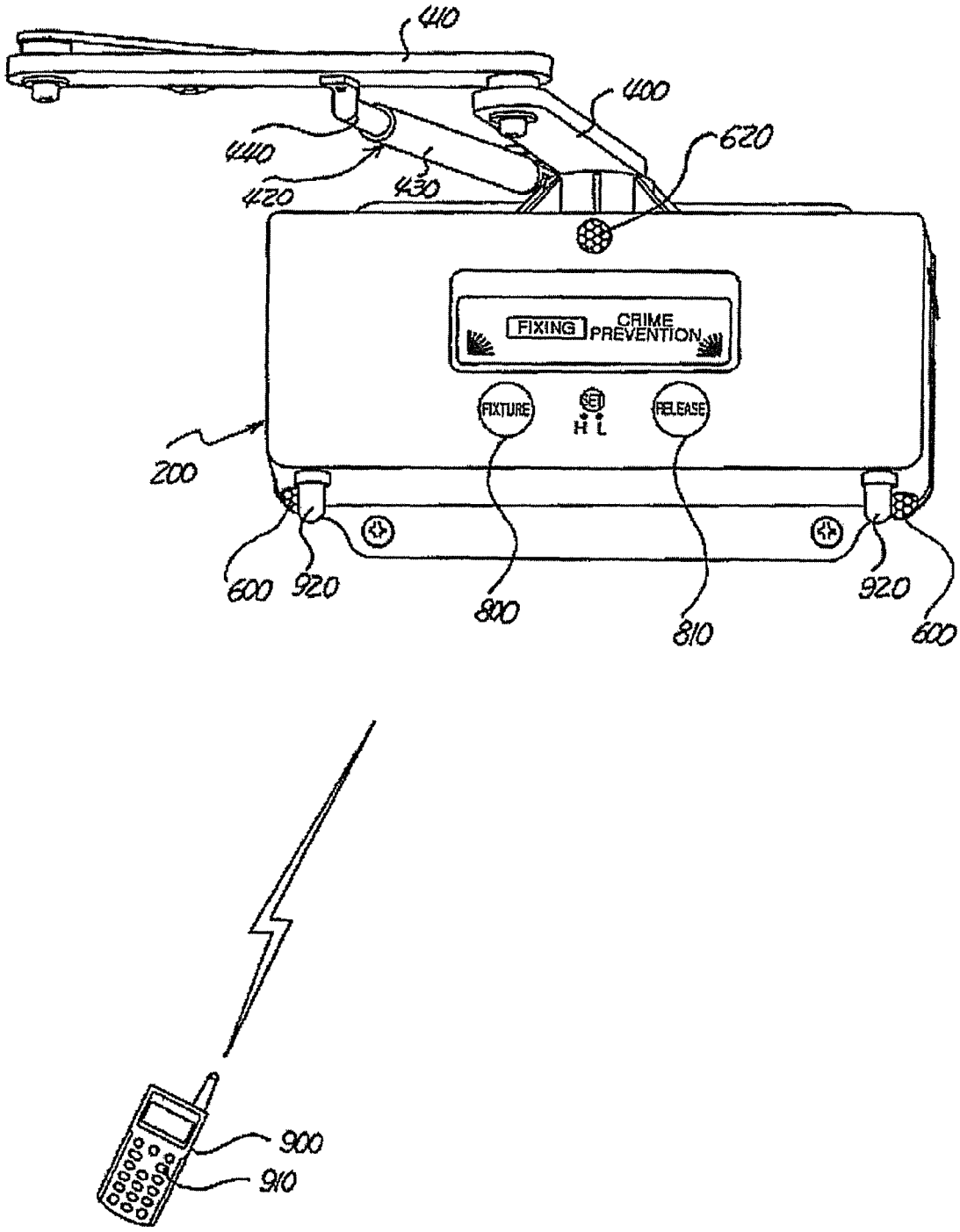
FIG. 3 is an enlarged perspective view showing essential components of the multi doorlock according to the present invention.
Figure 4:
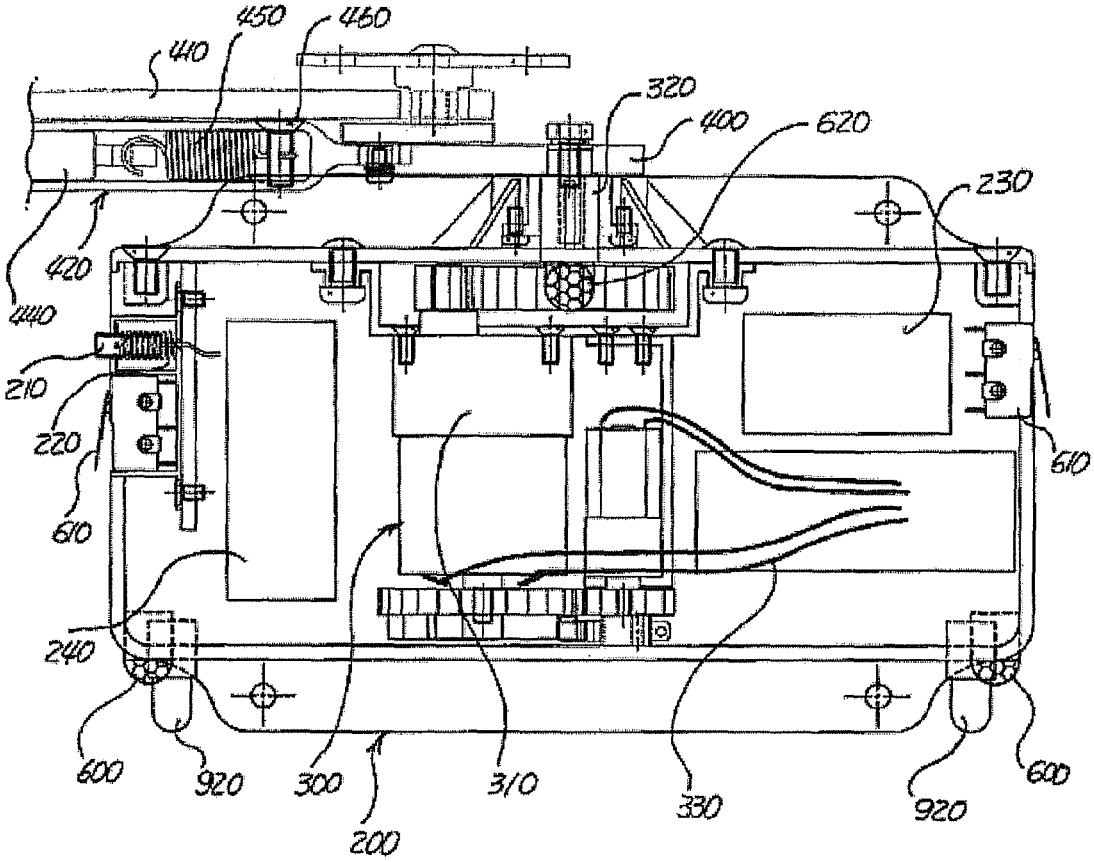
FIG. 4 is a front view showing the interior of the multi doorlock according to the present invention.
Figure 5:
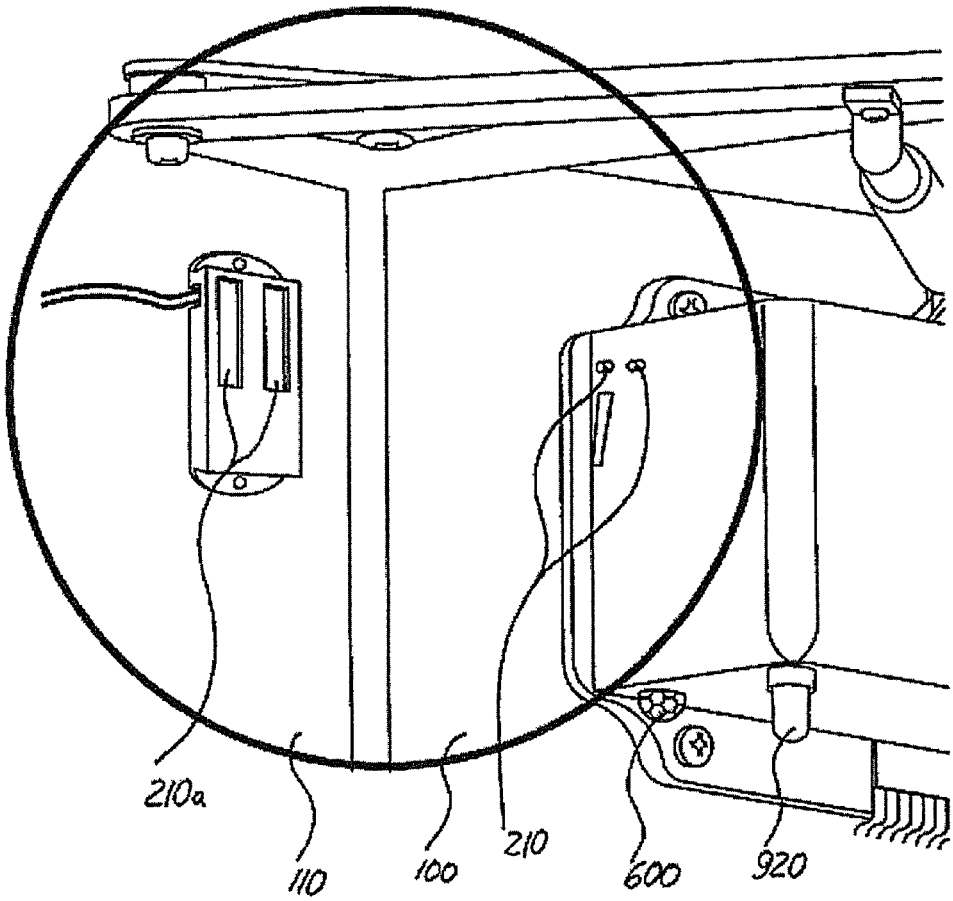
FIG. 5 is an enlarged view showing the A portion of FIG. 1.
Figure 6:
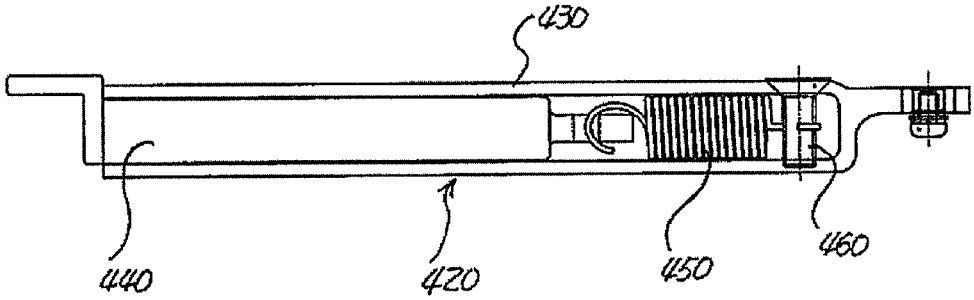
FIG. 6 is a sectional view showing a door-closing cylinder according to the present invention.
Figure 7:
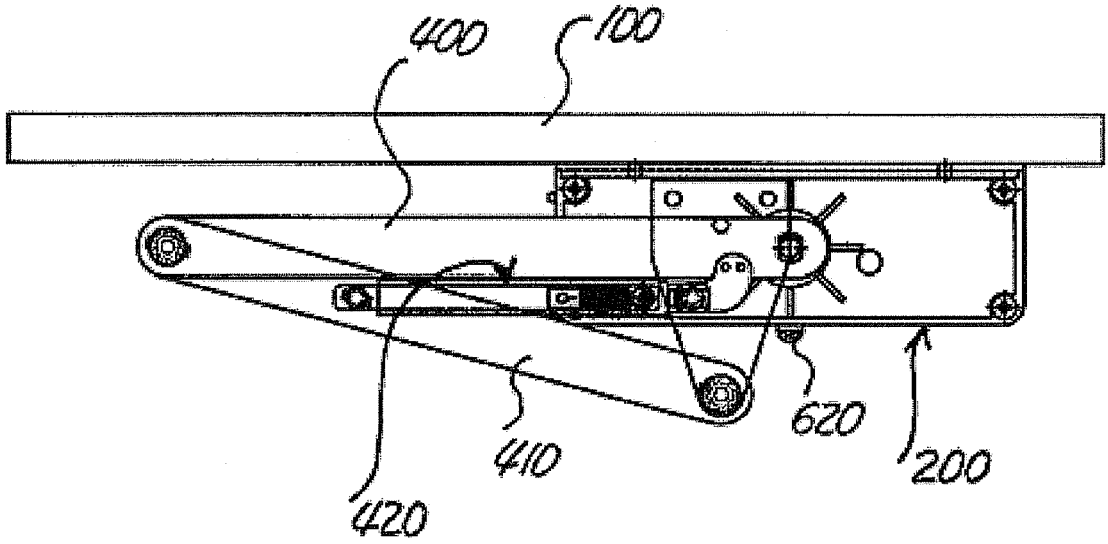
FIG. 7 is a plane view showing a hinged door closed by the multi doorlock according to the present invention.
Figure 8:
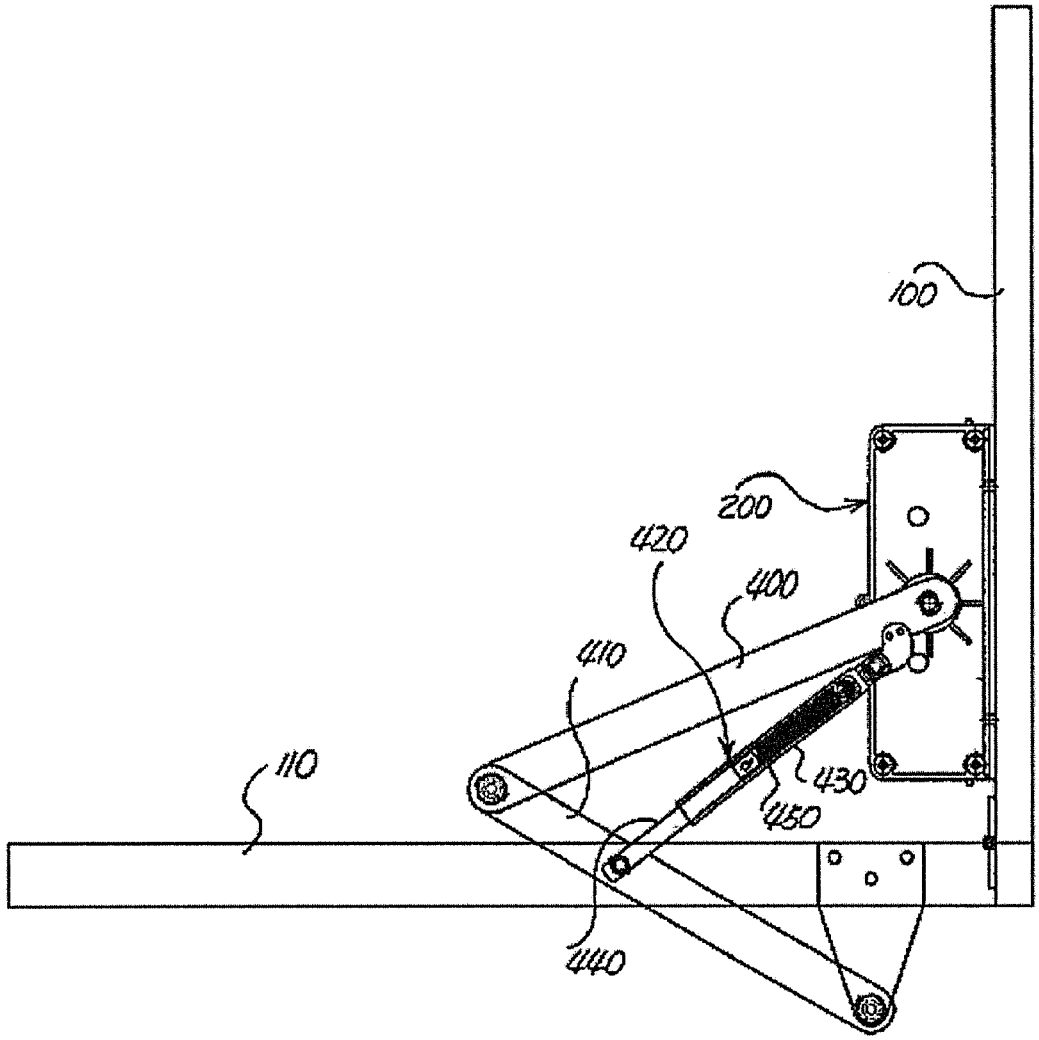
FIG. 8 is a plane view showing the hinged door opened by the multi doorlock according to the present invention.
Figure 9:
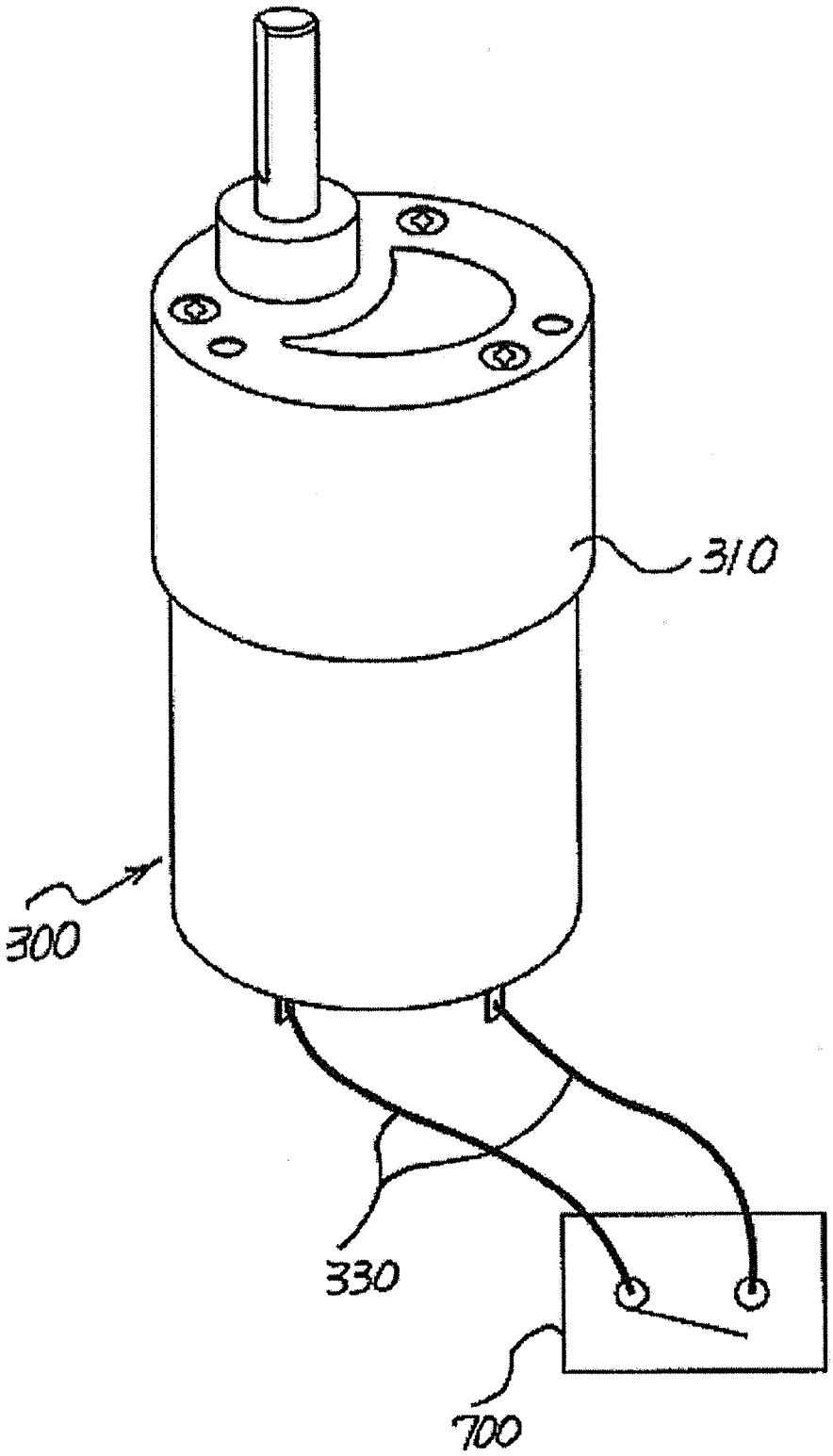
FIG. 9 is a schematic view showing a DC motor employed in the multi doorlock according to the present invention.
Figure 10:
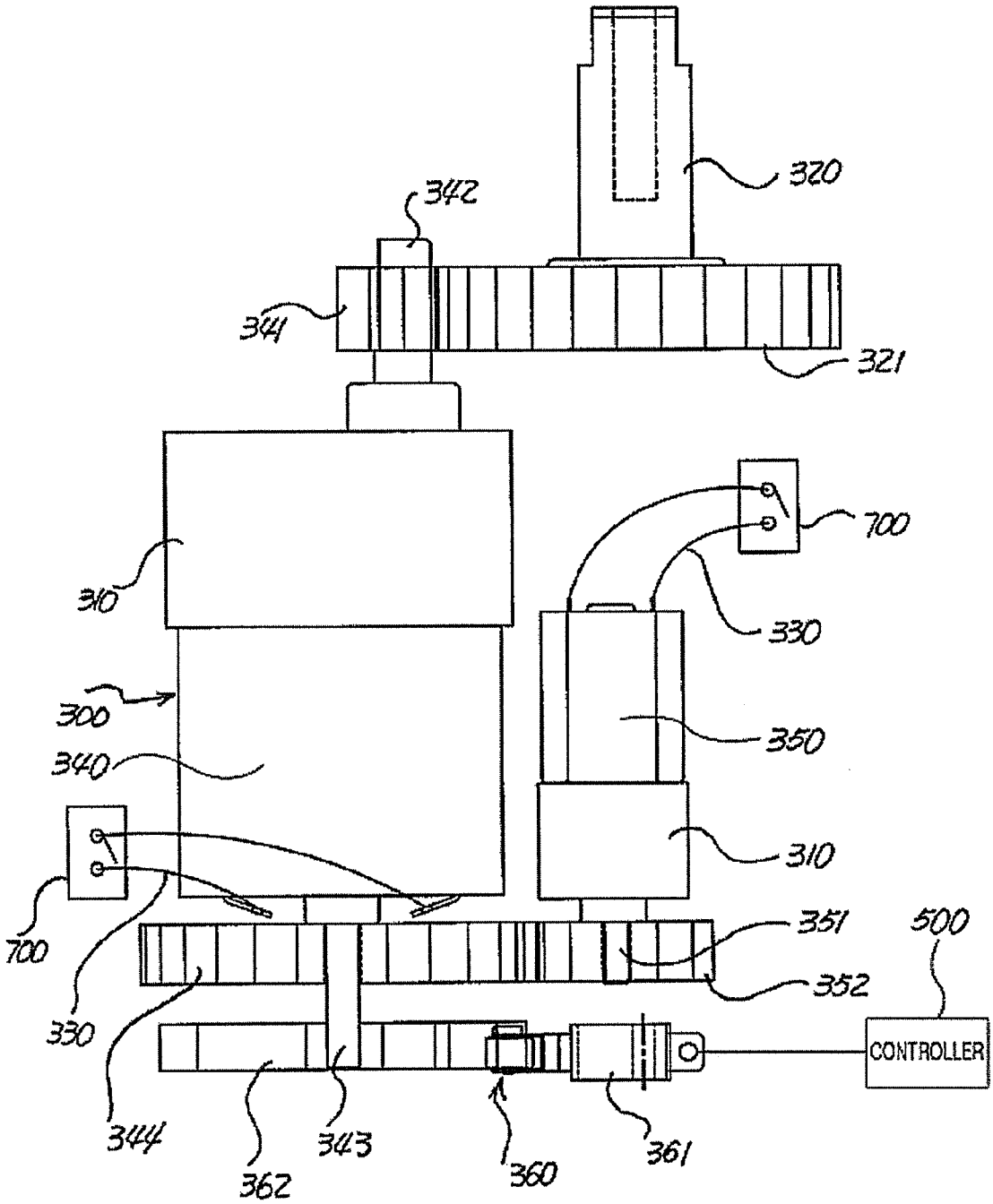
FIG. 10 is a schematic view showing the interior of the DC motor employed in the multi doorlock according to the present invention.
Figure 11:
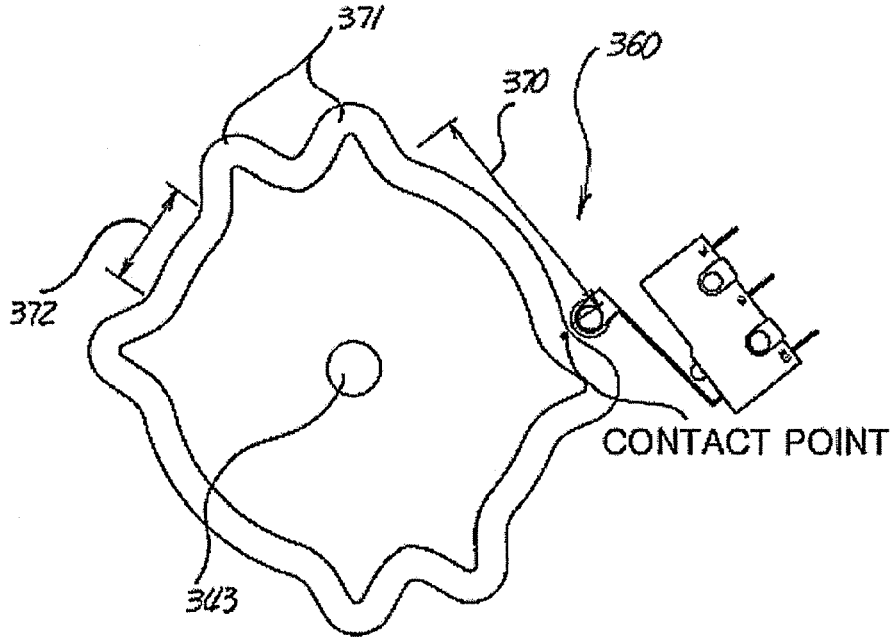
FIG. 11 is a bottom view showing a rotation sensor employed in the multi doorlock according to the present invention.
Figure 11:
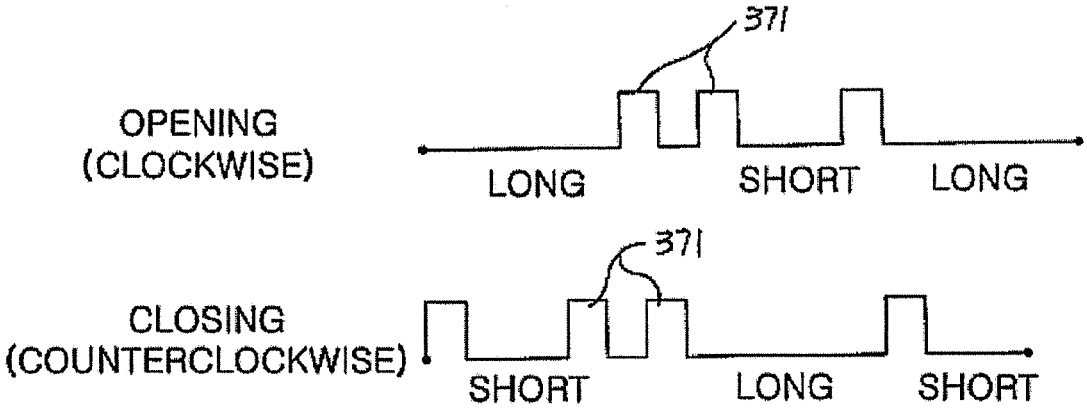
Figure 12:
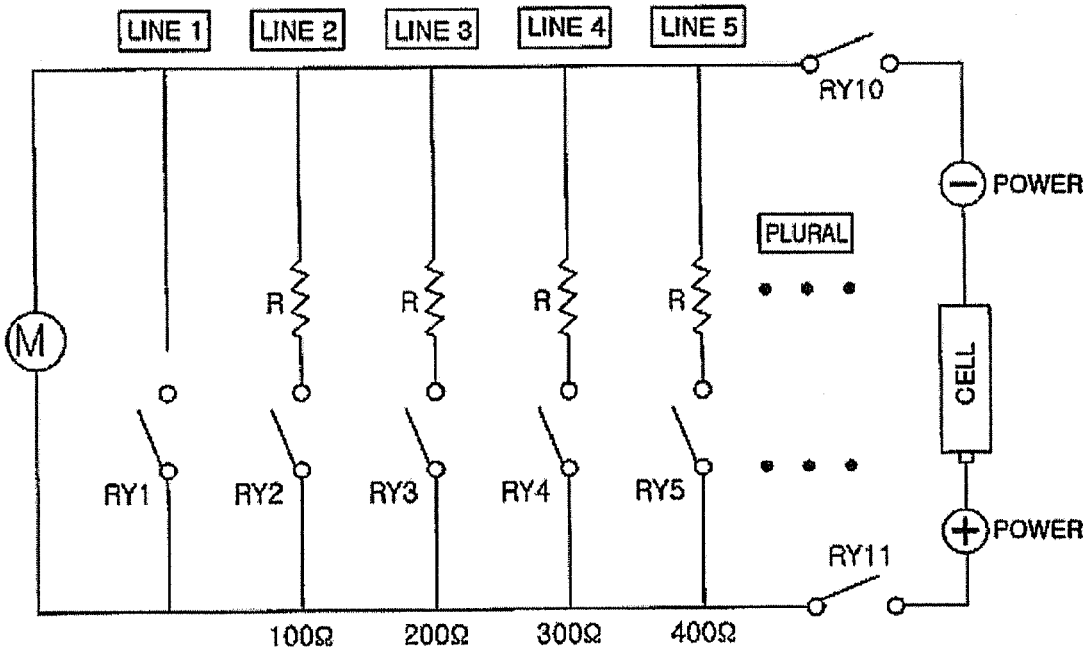
FIG. 12 is a circuitry diagram illustrating how a braking resistance of the DC motor employed in the present invention is changed.

FIG. 1 is a perspective view showing a multi doorlock according to the present invention, which is installed to a hinged door, FIG. 2 is a perspective view showing the multi doorlock according to the present invention, FIG. 3 is an enlarged perspective view showing essential components of the multi doorlock according to the present invention, FIG. 4 is a front view showing the interior of the multi doorlock according to the present invention, FIG. 5 is an enlarged view showing the A portion of FIG. 1, FIG. 6 is a sectional view showing a door-closing cylinder according to the present invention, FIG. 7 is a plane view showing a hinged door closed by the multi doorlock according to the present invention, FIG. 8 is a plane view showing the hinged door opened by the multi doorlock according to the present invention, FIG. 9 is a schematic view showing a DC motor employed in the multi doorlock according to the present invention, FIG. 10 is a schematic view showing the interior of the DC motor employed in the multi doorlock according to the present invention, FIG. 11 is a bottom view showing a rotation sensor employed in the multi doorlock according to the present invention, and FIG. 12 is a circuitry diagram illustrating how a braking resistance of the DC motor employed in the present invention is changed.

The multi doorlock according to the present invention includes a doorlock unit 200 installed to a hinged door 100, a non-powered DC motor 300 installed to the doorlock unit, links 400, 410 connected to the DC motor at one end and installed to a doorframe at the other end, the links being folded or unfolded when the hinged door is closed or opened, and a relay switch 700 connected to both ends of a power line 330 of the DC motor 300 and shorting the DC motor on occasions, as shown in FIGS. 1 to 12. The doorlock unit 200 frequently changes a braking resistance of the DC motor 300 while the hinged door 100 is opened or closed, thereby controlling an opening/closing speed of the hinged door. When it is intended to fix the hinged door 100, the DC motor 300 is shorted using the relay switch 700 to give a braking force such that the hinged door does not move.

The DC motor 300 is connected with a braking resistor, and its braking resistance is frequently changed according to the opening/closing operation of the hinged door 100. In other words, as the braking resistance is greater, the DC motor 300 allows the hinged door to be easily opened with a small force. Also, as the braking resistance of the DC motor 300 is smaller, the hinged door may be closed more slowly. In more detail, as a braking resistance is subsequently increased in the order of 100Ω, 200Ω, 300Ω and 400Ω as shown in FIG. 12, the DC motor 300 may rotate more easily, and accordingly the hinged door 100 may be easily opened with a small force. Also, as the braking resistance is subsequently decreased in the order of 400Ω, 300Ω, 200Ω and 100Ω, the DC motor 300 may be more difficultly rotated, and accordingly, the hinged door is more slowly closed to relieve an impact when the hinged door is completely closed. When the hinged door 100 is completely closed, the braking resistance is set as 0 (zero) such that the DC motor 300 is not rotated, and accordingly the hinged door is fixed when it is completely closed.

The DC motor 300 includes a final output shaft 320 at a lower end of which a first gear 321 is integrally formed; a first DC motor 340 having a first output shaft 342 at a lower end of which a second gear 341 engaged with the first gear 321 is integrally formed and a rotary shaft 343 at a lower end of which a third gear 344 is integrally formed; and a second DC motor 350 having a second output shaft 351 to which a fourth gear 352 engaged with the third gear 344 is integrally formed.

A reduction gear 310, a power line 330 and a relay switch 700 are respectively installed to the first DC motor 340 and the second DC motor 350, substantially identically.

A rotation sensor 360 is formed at a lower end of the rotary shaft 343 of the first DC motor 340. The rotation sensor 360 includes a rotating cam 362 and a rotation sensing micro switch 361, in brief.

The rotating cam 362 is integrally connected onto the rotary shaft 343 and rotated in the same direction as the rotary shaft 343, substantially in a clockwise or counterclockwise direction. A long region 370, a rotation detection protrusion 371 and a short region 372 are repeatedly formed in an outer periphery of the rotating cam 362.

The rotation sensing micro switch 361 is closely adhered to the outer periphery of the rotating cam 362. If the rotating cam 362 rotates in a clockwise direction, the rotation sensing micro switch 361 detects that the hinged door 100 is being opened while repeatedly passing the long region 370, the rotation detection protrusion 371 and the short region 372 of the rotating cam 362 in order. Also, if the rotating cam 362 is rotated in a counterclockwise direction, the rotation sensing micro switch 361 detects that the hinged door 100 is being closed while repeatedly passing the short region 372, the rotation detection protrusion 371 and the long region 370 of the rotating cam 362 in order.

The rotation sensing micro switch 361 is electrically connected to a controller 500 of the doorlock unit 200. If the rotation sensing micro switch 361 detects a clockwise or counterclockwise rotation of the rotating cam 362, the controller 500 instantly changes a braking resistance of the DC motor 300 to control an opening/closing speed of the hinged door 100.

The overall configuration of the multi doorlock to which the DC motor 300 is installed is as follows. The multi doorlock of the present invention includes a doorlock unit 200 installed to one upper side of a hinged door 100 to control an opening/closing operation of the hinged door using a braking resistance of a DC motor 300 mounted therein, and links 400, 410 respectively having one end connected to a final output shaft 320 located at the top of the DC motor 300 and the other end installed to an upper end of a doorframe such that the links 400, 410 are folded or unfolded to close or open the hinged door 100.

The multi doorlock may have a finger jamming prevention function, a fixing function for keeping an opened or closed state of a hinged door, and a crime prevention function.

The doorlock unit 200 is installed at the top of the hinged door 100 and organically connected to the links 400, 410 to control an opening/closing operation of the hinged door.

In detail, the non-powered DC motor 300 having a reduction gear 310 at its top is installed in the doorlock unit 200. Also, the doorlock unit 200 has one end connected to the final output shaft 320 engaged with the reduction gear 310, and the other end installed at the top of the hinged door 100. In this state, the doorlock unit 200 is connected to the links 400, 410 that are naturally moved while the hinged door is opened or closed.

At this time, the doorlock unit 200 may further include a finger jamming detection sensor 600. The finger jamming detection sensor 600 is protruded out at a lower end of the doorlock unit 200 to detect whether a finger is located between the hinged door 100 and the doorframe. If it is detected that a finger is located between the hinged door and the doorframe, the finger jamming detection sensor 600 transmits a corresponding signal to the controller 500.

The doorlock unit 200 also includes a relay switch 700. The relay switch 700 is connected to both ends of a power line 330 of the DC motor 300. In this state, if the finger jamming detection sensor 600 detects that a finger is located between the hinged door 100 and the door frame, the controller 500 controls the relay switch 700 to short the non-powered DC motor 300, thereby fixing the final output shaft 320. If the final output shaft 320 is fixed, the movement of the links 400, 410 is intercepted such that the hinged door 100 is not closed any more, thereby preventing the finger located between the hinged door and the doorframe from being damaged.

The DC motor 300 is always in a non-powered state, and it keeps its non-powered state though the relay switch 700 is operated. In other words, since the DC motor 300 is in a non-powered state, the final output shaft 320 of the DC motor 300 may freely rotate in ordinary times. In this case, the links 400, 410 may also freely move, so the hinged door 100 may be freely opened or closed.

However, if the relay switch 700 is operated, the DC motor 300 is shorted. If the DC motor 300 is shorted, the final output shaft 320 is fixed, so the links 400, 410 are not moved further. As mentioned above, the DC motor 300 plays a role of brake in a non-powered state such that the hinged door 100 is not opened or closed.

The relay switch 700 is turned on/off using a general dry cell 240 or a rechargeable cell 230 provided in the doorlock unit 200. The general dry cell 240 may be exchanged with another one, and the rechargeable cell 230 may be charged.

The rechargeable cell 230 is charged as follows. A first connection terminal 210 electrically connected to the rechargeable cell 230 is installed at a side of the doorlock unit 200, and the first connection terminal 210 may be moved forward and backward by means of a spring 220. Also, the second connection terminal **210*a* is installed at a corresponding position of the doorframe 110 such that it may be electrically connected to the first connection terminal 210, and the second connection terminal 210*a* is connected to a main power line (not shown) to play a role of applying power. In this configuration, if the hinged door is closed, the first connection terminal 210 is connected to the second connection terminal 210*a*, and in this state, the rechargeable cell 230** may be charged.

As an alternative, the rechargeable cell 230 may be electrically connected to the DC motor 300 such that it is charged using electricity generated by the DC motor when the DC motor is forcibly rotated while the hinged door 100 is opened or closed.

A door-closing cylinder 420 is installed between the links 400, 410. The door-closing cylinder 420 includes a hollow guide tube 430 connected to the link 400, a piston 440 having one end guided to be inserted into or drawn from the guide tube 430 and the other end connected to the link 410, and a restoring spring 450 having one end connected to the piston 440 and the other end connected to a fixing pin 460 installed at the link 400 so as to pull the piston 440 into the guide tube 430.

Now, a fixing function of the hinged door is explained as follows. A fixture button 800 and a release button 810 are installed to be electrically connected to the relay switch 700. In this case, if the fixture button 800 is pressed in a state that the hinged door 100 is opened or closed, the relay switch 700 is operated to fix the hinged door such that the hinged door may keep its opened or closed state. Similarly, if the release button 810 is pressed, the relay switch 700 is operated to release the fixed state of the hinged door 100.

Meanwhile, a cable 820 with a predetermined length is installed at a bottom of the doorlock unit 200, and the cable 820 is electrically connected to the controller 500 of the doorlock unit 200. An auxiliary fixture button 800*a* and an auxiliary release button 810*a* are formed at a lower end of the cable 820 such that children and old or weak persons may easily fix the hinged door 100 or release the fixture of the hinged door 100.

Now, a crime prevention function is explained. The multi doorlock of the present invention may further include a closing detection sensor 610 installed to the doorlock unit 200 to detect a closed state of the hinged door 100, and a remote controller 900 wirelessly communicated with the controller 500 of the doorlock unit 200 in real time and having a crime prevention button 910. The closing detection sensor 610 is electrically connected to the controller 500 of the doorlock unit 200.

In this configuration, if the crime prevention button of the remote controller is pressed in a state that the hinged door is closed and so the closing detection sensor 610 is in an "ON" state, the controller of the doorlock unit is shifted into a crime prevention mode. In the crime prevention mode, if an alien person forcibly opens the hinged door, the closing detection sensor is changed into an "OFF" state and gives a warning to the outside. To give a warning, an emergency bell may be ringed, or a lamp may be blinked.

A movement detection sensor 620 is installed to an outside of the doorlock unit 200. The movement detection sensor 620 detects an invasion of an alien person through a window by itself and then gives a warning to the outside by ringing an emergency bell or blinking a lamp.

When ringing an emergency bell or blinking a lamp through the closing detection sensor 610 or the movement detection sensor 620, the invasion of an align person may be notified to a user through a receiver module of a telephone.

Here, the finger jamming detection sensor 600, the closing detection sensor 610, the movement detection sensor 620, the relay switch 700, the transceiver 920, the remove controller 900 and the DC motor 300 are electrically connected to the controller 500 and supplied with power from the general dry cell 240 or the rechargeable cell 230. Also, an electrical circuit for operating the emergency bell and the lamp is provided at the multi doorlock. Such electric connection and circuit are commonly used in the related art, so they are not described in detail here.

The multi doorlock of the present invention, configured as above, may be use as follows. First, the doorlock unit 200 is organically connected to the links 400, 410 between the hinged door 100 and the doorframe 110. In this stage, the final output shaft 320 may freely rotate. Thus, if the hinged door 100 is opened or closed, the links 400, 410 freely moves not to disturb the opening/closing behavior of the hinged door 100.

In other words, when the hinged door 100 is opened or closed, since the first and second DC motors 340, 350 of the DC motor 300 are in a non-powered state, the final output shaft 320, the first gear 321, the second gear 341, the first output shaft 342, the rotary shaft 343, the third gear 344, the second output shaft 351, the fourth gear 352 and the links 400, 410 may be freely moved. If the hinged door 100 is opened or closed in this state, the final output shaft 320, the first gear 321, the second gear 341, the first output shaft 342, the rotary shaft 343, the third gear 344, the second output shaft 351, the fourth gear 352 and the links 400, 410 are organically moved to open or close the hinged door 100.

When the hinged door 100 is in a closed state, a braking resistance of the DC motor 300 is 0 (zero). Thus, if a closed hinged door is opened, when the hinged door 100 starts being opened, the braking resistance is subsequently increased in the order of 100Ω, 200Ω, 300Ω and 400Ω such that the hinged door may be easily opened with a small force.

On the contrary, if an opened hinged door 100 is closed, when the hinged door 100 is nearly closed, the braking resistance is subsequently decreased in the order of 400Ω, 300Ω, 200Ω and 100Ω. Thus, the hinged door 100 is closed slowly, thereby relieving an impact occurring when the hinged door 100 is closed. When the hinged door 100 is completely closed, the braking resistance is decreased to 0 (zero) to fix a closed state of the hinged door.

In order to fix an opened state or a closed state of the hinged door 100, a user presses the fixture button 800. In this case, the relay switch 700 is operated by means of the fixture button 800 to short the first and second DC motors 340, 350. The shorted first DC motor 340 intercepts movement of the first gear 321, the second gear 341, the first output shaft 342, the rotary shaft 343 and the third gear 344, and the shorted second DC motor 350 intercepts movement of the third gear 344, the second output shaft 351 and the fourth gear 352.

Thus, since the rotating force of the final output shaft 320 is intercepted, the links 400, 410 does not move, and so the hinged door 100 is fixed in an opened or closed state. This fixed state is released using the release button 810.

Meanwhile, when the hinged door 100 is opened or closed, the rotation sensor 360 detects such an opening/closing behavior of the hinged door. A sensing signal of the rotation sensor 360 is transmitted to the controller 500, and the controller 500 suitably changes a braking resistance of the DC motor 300 according to the sensing signal.

The braking resistance is changed as follows. The rotation sensing micro switch 361 is closely adhered to the rotating cam 362 as shown in FIG. 11. In this state, the rotating cam 362 connected onto the rotary shaft 343 of the first DC motor 340 is rotated in a clockwise or counterclockwise direction as the hinged door 100 is opened or closed.

At this time, if the rotating cam 362 is rotated in a clockwise direction (indicating that the hinged door is being opened), the rotation sensing micro switch 361 closely adhered to the outer periphery of the rotating cam 362 detects that the hinged door 100 is being opened while subsequently passing the long region 370, the rotation detection protrusion 371 and the short region 372 repeatedly. Also, if the rotating cam 362 is rotated in a counterclockwise direction (indicating that the hinged door is being closed), the rotation sensing micro switch 361 detects that the hinged door 100 is being closed while subsequently passing the short region 372, the rotation detection protrusion 371 and the long region 370 repeatedly.

If the signal sensed by the rotation sensing micro switch 361 is transmitted to the controller 500, the controller 500 instantly changes a braking resistance of the DC motor 300 such that the hinged door 100 may be opened or closed at a suitable speed.

Meanwhile, in case the rechargeable cell 230 is used, the rechargeable cell 230 is charged as follows. When the hinged door 100 is opened or closed, the DC motor 300 is forcibly rotated to generate electricity. At this time, the rechargeable cell 230 is charged using the generated electricity. Also, if the hinged door 100 is closed, the first connection terminal 210 is electrically connected to the second connection terminal 210*a* formed at the doorframe, and the rechargeable cell 230 is charged through the first connection terminal 210 and the second connection terminal 210*a*.

When the hinged door 100 is in a closed state, the links 400, 410 are folded with each other as shown in FIG. 7. Also, the piston 440 is inserted into the guide tube 430, and the restoring spring 450 is in a compressed state. In this state, if the hinged door 100 is opened, the links 400, 410 are unfolded with each other as shown in FIG. 8. Also, due to the unfolded links 400, 410, the piston 440 is drawn out from the inside of the guide tube 430 while overcoming a spring force of the restoring spring 450. Thus, the hinged door 100 in an opened state may be easily closed using the restoring force of the restoring spring 450.

Meanwhile, if a finger or the like is located in the gap formed between the hinged door 100 and the doorframe 110, the finger jamming detection sensor 600 detects it. A sensing signal of the finger jamming detection sensor 600 is transmitted to the controller 500, and the controller 500 operates the relay switch 700 according to the sensing signal. At this time, if the relay switch 700 connected to the power line 330 of the DC motor 300 is operated to short the DC motor, the DC motor 300 intercepts the rotation of the final output shaft 320 such that the links 400, 410 do not move. Thus, the hinged door 100 is not closed, thereby preventing the finger from being compressed between the hinged door 100 and the doorframe.

In addition, if the fixture button 800 is pressed to keep an opened state of the hinged door 100 for the purpose of cleaning or the like, the relay switch 700 is operated by means of the fixture button 800 to short the DC motor. In this case, the DC motor 300 intercepts the rotation of the final output shaft 320 such that the links 400, 410 do not move. Thus, the hinged door 100 may keep its opened state. The fixed state may be released using the release button 810.

If a user presses the fixture button 800 while the hinged door 100 is in a closed state, the final output shaft 320 does not move in the above way. Thus, the fixing function of the hinged door 100 may be realized in a closed state. In addition, if the crime prevention button 910 of the remote controller 900 is pressed in a closed state, the signal is transmitted to the controller 500 through the transceiver 920, and the controller 500 receiving the crime prevention signal is shifted to a crime prevention mode.

If an alien person forcibly opens the hinged door 100 in the crime prevention mode, the closing detection sensor 610 detects that the hinged door is opened. The sensing signal of the closing detection sensor 610 is transmitted to the controller 500 to ring an emergency bell or blink a lamp, thereby notifying invasion of an alien person to the outside.

The movement detection sensor 620 detects an invasion of an alien person who does not make an invasion through the hinged door 100 but makes an invasion through a window or the like. If the movement detection sensor 620 detects an invasion of an alien person, the sensing signal is transmitted to the controller 500. The controller 500 receiving the sensing signal rings an emergency bell or blinks a lamp to notify invasion of an alien person to the outside.

In addition, if an alien person makes an invasion when the controller 500 is in a crime prevention mode as mentioned above, a telephone call is made to a previously input phone number through a receiving module of a telephone, so a user may easily check an invasion of an alien person even at an exterior place.

APPLICABILITY TO THE INDUSTRY

As described above, according to the present invention, the multi doorlock may be used for various purposes since a finger jamming prevention function, a door fixing function and a crime prevention function are basically provided to the multi doorlock.

Also, a non-powered DC motor is installed to the doorlock unit installed to a hinged door, and the DC motor changes its braking resistance frequently according to an opening or closing operation of the hinged door, so the opening/closing operation of the hinged door may be easily controlled.

In addition, since the braking resistance of the DC motor is increased when the hinged door is opened, the hinged door may be easily opened with a small force.

Also, the braking resistance of the DC motor is decreased when the hinged door is closed, and also the braking resistance is more increased when the hinged door is completely closed, so it is possible to decrease an impact occurring when the hinged door is closed.

In particular, if a finger or the like is located at a gap formed between the hinged door and the doorframe while the hinged door is in an opened state, the multi doorlock detects the finger and then forcibly prevents the hinged door from being closed, thereby preventing the finger from being jammed and thus protecting a user against any accident.

Also, the multi doorlock has a door fixing function. The hinged door may be fixed in an opened state due to the door fixing function, so it is possible to prevent the hinged door from being abruptly closed due to any external interference or wind. In addition, when a user goes out of doors, the hinged door is fixed in a closed state, so the multi doorlock may give a general locking function.

Also, the multi doorlock has a crime prevention function. Thus, if an alien person intends to forcibly open the hinged door, the crime prevention function is executed to ring an emergency bell or blink a lamp, so the user can be aware of invasion of an alien person, and the alien person should run away without invading into the door due to the crime prevention function.

In addition, the multi doorlock is provided with a movement detection sensor. Thus, if an alien person makes an invasion through a window or the like, the movement detection sensor is operated to send a telephone call to a communication terminal of a user such as a cellular phone, so the user can easily know invasion of an alien person even at an outer place.

What is claimed is:

1. A multi doorlock using a braking resistance of a DC motor, comprising:

a doorlock unit (200) installed to a hinged door (100);

a non-powered DC motor (300) installed to the doorlock unit; and links (400) (410) having one ends connected to the DC motor and the other ends installed to a doorframe, the links being folded or unfolded with each other when the hinged door is closed or opened, wherein the doorlock unit (200) frequently changes a braking resistance of the DC motor (300) while the hinged door (100) is opened or closed, thereby controlling an opening/closing speed of the hinged door.

2. The multi doorlock using a braking resistance of a DC motor according to claim 1, further comprising a relay switch (700) connected to both ends of a power line (330) of the DC motor (300) to short the DC motor on occasions, wherein, when it is intended to fix the hinged door (100), the relay switch (700) is operated to short the DC motor (300) such that the hinged door is not moved.

3. The multi doorlock using a braking resistance of a DC motor according to claim 2, further comprising:

a first connection terminal (210) installed at a side of the doorlock unit (200) to be elastically protruded by a spring (220), the first connection terminal (210) being electrically connected to a rechargeable cell (230) that supplies power to the relay switch (700); and a second connection terminal (210*a*) installed at a position of a doorframe corresponding to the first connection terminal (210), the second connection terminal (210*a*) being connected to a main power line to supply power, wherein the first connection terminal (210) and the second connection terminal (210*a*) are connected with each other to charge the rechargeable cell (230) when the hinged door is in a closed state.

4. The multi doorlock using a braking resistance of a DC motor according to claim 2, wherein a rechargeable cell (230) is installed to the doorlock unit (200) to supply power to the relay switch (700), and the rechargeable cell (230) is electrically connected to the DC motor (300) such that the rechargeable cell (230) is charged using electricity generated from the DC motor when the DC motor is forcibly rotated while the hinged door (100) is opened or closed.

5. The multi doorlock using a braking resistance of a DC motor according to claim 2, wherein the doorlock unit (200) includes a fixture button (800) and a release button (810) for operating the relay switch (700), wherein, when the fixture button (800) is pressed, the relay switch (700) shorts the DC motor to fix the hinged door (100) in an opened or closed state, and wherein, when the release button (810) is pressed, a fixed state of the hinged door (100) is released.

6. The multi doorlock using a braking resistance of a DC motor according to claim 5, wherein the doorlock unit (200) includes:

a cable (820) electrically connected to the doorlock unit (200) and having a predetermined length; and an auxiliary fixture button (800*a*) and an auxiliary release button (810*a*) installed to a lower end of the cable (820) and having the same function as the fixture button (800) and the release button (810), whereby the operation of fixing or releasing the hinged door (100) is allowed to children and old or weak persons.

7. The multi doorlock using a braking resistance of a DC motor according to claim 1, wherein the DC motor (300) includes:

a final output shaft (320) to which a first gear (321) is integrally formed;

a first DC motor (340) having a first output shaft (342) to which a second gear (341) engaged with the first gear (321) is integrally formed, and a rotary shaft (343) to which a third gear (344) is integrally formed; and a second DC motor (350) having a second output shaft (351) to which a fourth gear (352) engaged with the third gear (344) is integrally formed.

8. The multi doorlock using a braking resistance of a DC motor according to claim 7, further comprising a rotation sensor (360) formed at the rotary shaft (343) of the first DC motor (340).

9. The multi doorlock using a braking resistance of a DC motor according to claim 8, wherein the rotation sensor (360) includes:

a rotating cam (362) integrally connected to the rotary shaft (343) to rotate in the same direction as the rotary shaft (343), the rotating cam (362) having a long region (370), a rotation detection protrusion (371) and a short region (372) repeatedly formed on an outer periphery thereof; and a rotation sensing micro switch (361) closely adhered to the outer periphery of the rotating cam (362) to detect rotation of the rotating cam, wherein the rotation sensing micro switch determines that the hinged door (100) is being opened, in case the rotating cam (362) is rotated in a clockwise direction to subsequently pass the long region (370), the rotation detection protrusion (371) and the short region (372) repeatedly, and wherein the rotation sensing micro switch determines that the hinged door (100) is being closed, in case the rotating cam (362) is rotated in a counterclockwise direction to subsequently pass the short region (372), the rotation detection protrusion (371) and the long region (370) repeatedly.

10. The multi doorlock using a braking resistance of a DC motor according to claim 9, wherein the rotation sensing micro switch (361) is electrically connected to a controller (500) of the doorlock unit (200), and wherein, when the rotation sensing micro switch (361) detects a clockwise or counterclockwise rotation of the rotating cam (362), the controller (500) instantly changes a braking resistance of the DC motor (300) to control an opening/closing speed of the hinged door (100).

11. The multi doorlock using a braking resistance of a DC motor according to claim 1, further comprising a finger jamming detection sensor (600) protruded out of the doorlock unit (200) to detect whether a finger is located between the hinged door (100) and the doorframe.

12. The multi doorlock using a braking resistance of a DC motor according to claim 1, further comprising:

a closing detection sensor (610) installed to the doorlock unit (200) to detect a closing state of the hinged door (100); and a remote controller (900) wirelessly communicated with a controller (500) of the doorlock unit (200) in real time and having a crime prevention button (910), wherein, in case the crime prevention button of the remote controller is pressed in a state that the hinged door is closed and thus the closing detection sensor (610) is in an "ON" state, the controller of the doorlock unit is shifted into a crime prevention mode, and wherein, in the crime prevention mode, in case an alien person forcibly opens the hinged door, the closing detection sensor is shifted into an "OFF" state and notifies the fact to the outside.

13. The multi doorlock using a braking resistance of a DC motor according to claim 1, further comprising a movement detection sensor (620) installed to the doorlock unit (200) to detect an indoor movement, wherein the movement detection sensor detects invasion of an alien person and notifies the fact to the outside using an emergency bell and/or a lamp.

14. The multi doorlock using a braking resistance of a DC motor according to claim 1, further comprising a door-closing cylinder (420) installed between the links (400) (410), wherein the door-closing cylinder (420) includes:

a hollow guide tube (430) connected to the link (400);

a piston (440) having one end guided to be inserted into or drawn from the guide tube (430) and the other end connected to the link (410); and a restoring spring (450) having one end connected to the piston (440) and the other end connected to a fixing pin (460) installed to the link (400) to pull the piston (440) into the guide tube (430).

* * * * *